United States Patent [19]

Helbig

[11] 4,312,423

[45] Jan. 26, 1982

[54] PACKAGING AND ENERGY SAVING DEVICES AND METHODS

[76] Inventor: Earl G. Helbig, 18 Gray's Farm Rd., Weston, Conn. 06883

[21] Appl. No.: 82,158

[22] Filed: Oct. 5, 1979

[51] Int. Cl.[3] ..... E04F 11/06; E06C 9/00

[52] U.S. Cl. ..... 182/46; 182/81; 206/216; 206/523

[58] Field of Search ..... 182/46, 47, 77–81; 206/523, 216; 220/410

[56] References Cited

U.S. PATENT DOCUMENTS

| | | | |
|---|---|---|---|
| 3,531,327 | 9/1970 | Moos | 206/523 |
| 3,842,935 | 10/1974 | Frank | 182/181 |
| 4,151,894 | 5/1979 | Edwards | 182/46 |
| 4,281,743 | 8/1981 | Fuller | 182/46 |

FOREIGN PATENT DOCUMENTS

| | | | |
|---|---|---|---|
| 204152 | 7/1959 | Austria | 182/47 |
| 468575 | 10/1950 | Canada | 182/81 |
| 242799 | 12/1946 | Switzerland | 182/81 |

*Primary Examiner*—Reinaldo P. Machado
*Attorney, Agent, or Firm*—William G. Rhines

[57] ABSTRACT

This invention relates to the field of packaging and fuel saving devices and to articles and methods therefor. One embodiment comprises a shipping container for unitized attic stairs. The container is made from rigid plastic foam material which has good thermal insulating characteristics and is so dimensioned as to fit snugly on the peripheral frame of the stair unit after it has been installed. As such, it provides a removeable thermal barrier for the stair-well between an attic and the living quarters of a home. Other embodiments include a matching container member made from similar material which may be utilized in conjunction with the first member so as to further enhance the fuel saving characteristics of the finished installation.

11 Claims, 7 Drawing Figures

Fig. 2.
(PRIOR ART)
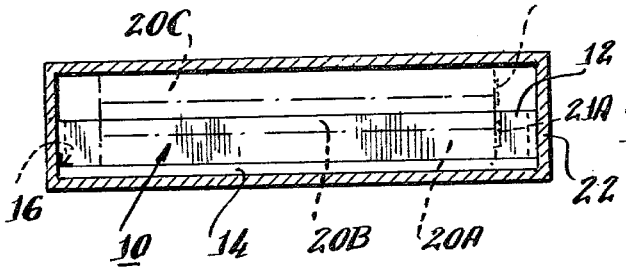
Fig. 1.
(PRIOR ART)
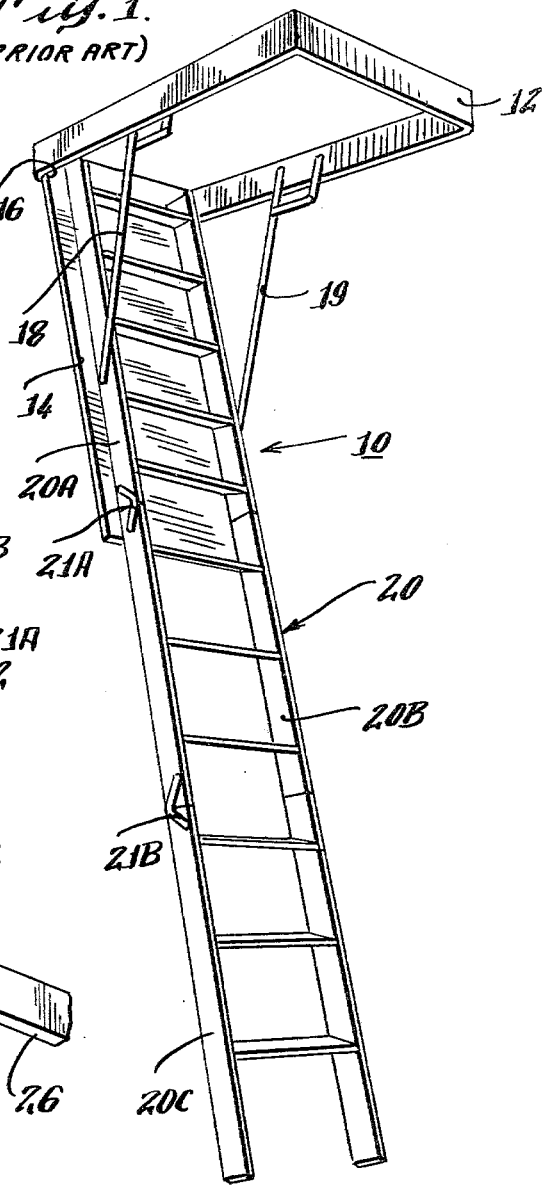
Fig. 3.
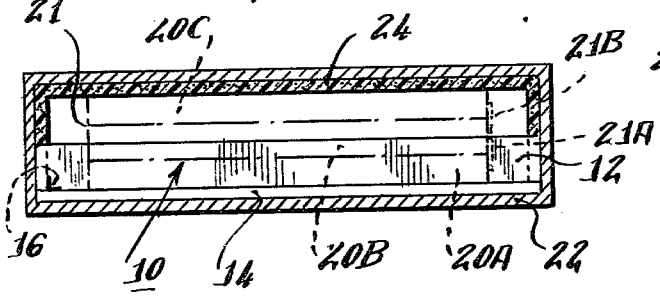
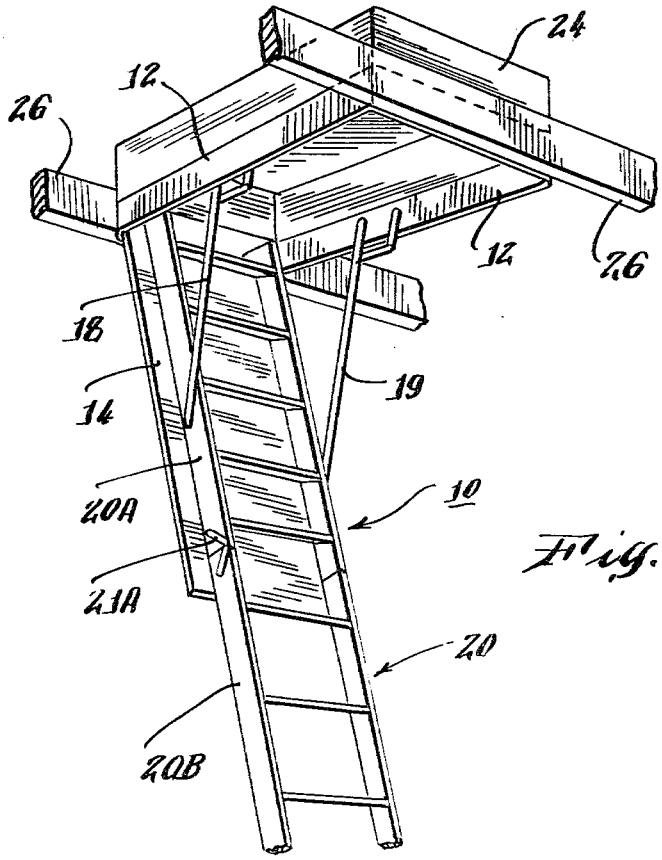
Fig. 4.

Fig. 5.
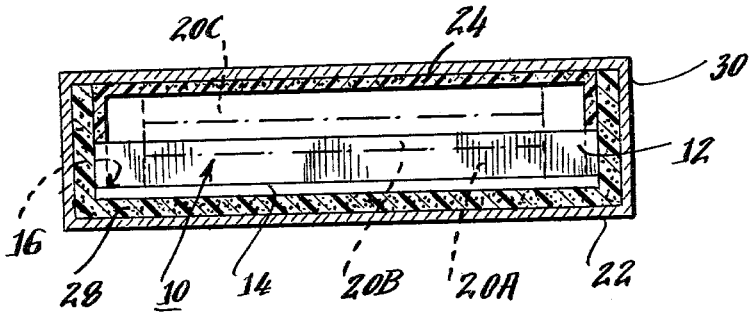
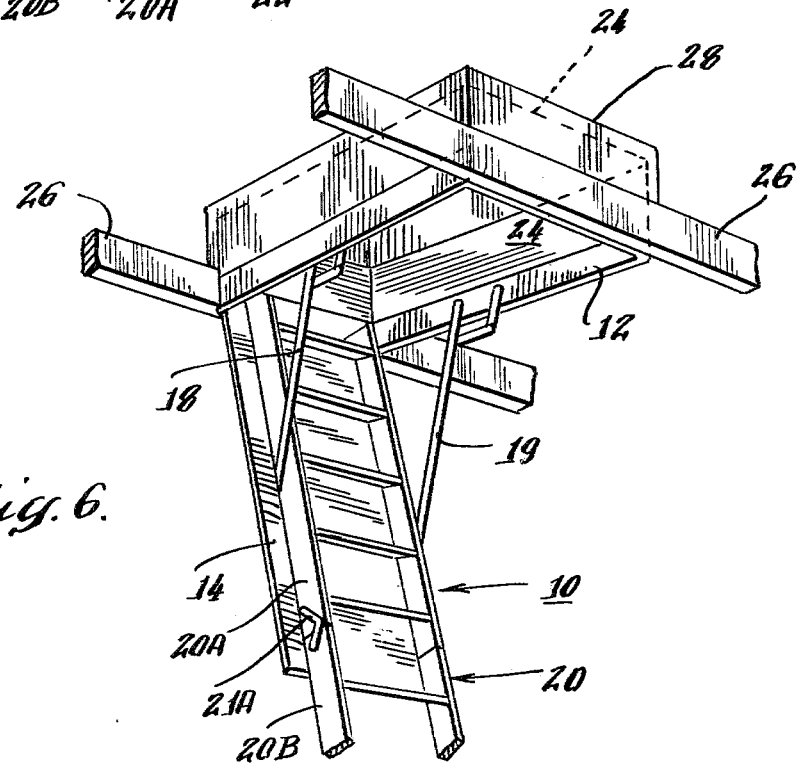
Fig. 6.
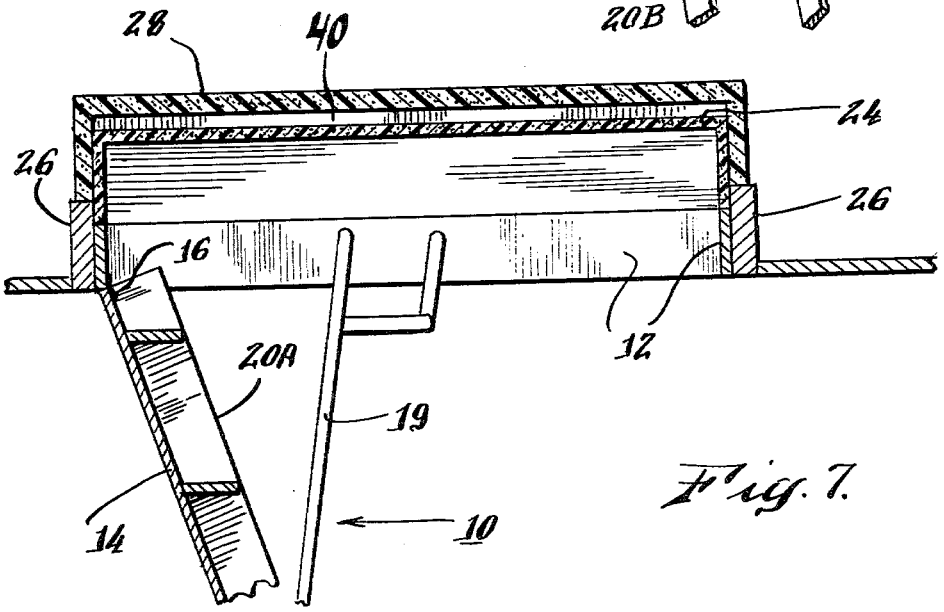
Fig. 7.

PACKAGING AND ENERGY SAVING DEVICES AND METHODS

BACKGROUND OF THE INVENTION

The use of unitized attic stair structures is known per se. Typically, they are pre-fabricated units which include a stairwell frame which is secured to the floor joist of an attic floor at the level of the attic floor and the ceiling of the living quarters beneath the attic. A ladder, often in three sections which are hinged to each other end-to-end, is so arranged with respect to a closure panel that may be swung in and out of closed position within the stairwell frame. Thus, when it is desired to enter the attic, the panel is swung downward with respect to the stairwell frame, and the ladder is extended to the floor level of the living quarters floor. By this means, access to the attic may be gained readily, without the necessity of a permanently positioned stair arrangement which limits or otherwise compromises the living quarters portion of the structure for other purposes. In the pre-fabricated form, such stair units are usually shipped from the factory in standard corrugated cartons. While adequate for normal shipping circumstances, such cartons do not provide a desired extra margin of protection for the rather intricate structure which it contains.

Further, the stairwell units themselves, when positioned in place for access to the attic portion of a house, for example, can, by their very nature, provide only limited thermal barrier features, and thus are a source of substantial heat loss into the attic area. This is because substantially all of the inhibition of free heat loss, as in a standard open stairwell, is provided by the closure panel, which is typically a sheet of plywood. Due to the intricacies of the stair, spring, and suspension members associated with the entire mechanism, as a practical matter, it is difficult or impossible to substantially totally eliminate heat loss through the panel or around its peripheral edges, while preserving the ability for easy ingress and egress and not substantially disfiguring the appearance of the living quarters section of the house.

Accordingly, it is an object of this invention to provide improved packaging means for pre-fabricated building structure units.

A further object is to provide such means for use with such units where the units characteristically present heat-loss disadvantages after installation.

Another object is to provide means for achieving the foregoing objects which may be utilized to effect thermal insulation advantages in conjunction with the installation of such units.

Yet another objective of the invention is to provide a means for effecting improved packaging, which may also be utilized to effect thermal insulation advantages; all in accordance with the foregoing.

SUMMARY OF INVENTION

Desired objectives may be achieved through practice of the present invention wherein there is provided a first member for use to package for shipment a pre-fabricated building unit, such as folding attic stairs. The member may be made from rigid material that has good thermal insulating characteristics. The member is of substantially the same peripheral configuration and dimensions as the outer frame of the unit. Optionally, there may be a second member which may be used in conjunction with the first, to provide further packaging advantages and to provide additional thermal insulation features for the unit as it is installed. As aids to shipment, the first member provides a means for holding the pre-fabricated unit in place within its outer shipping container. The second member may provide such an outer shipping member. Upon installation of the unit, the first member may be removeably positioned above the unit, held by its peripheral frame, to provide an effective thermal barrier, and a second member, if used, may be positioned about the first member to provide even more thermal barrier advantages.

DESCRIPTION OF DRAWINGS

This invention may be understood from the description which follows and from the appended drawings in which FIG. 1 is a perspective view of a typical prefabricated home folding stair unit, FIG. 2 is a cross-sectional view of the prior art method of packaging units of the type shown in FIG. 1, FIG. 3 is a cross-sectional view of one embodiment of this invention used as in conjunction with packaging for a unit of the type shown in FIG. 1, FIG. 4 is a perspective view of the embodiment of this invention shown in FIG. 3 in use as a thermal barrier, FIG. 5, is a cross-sectional view of another embodiment of this invention, FIG. 6 is a perspective view of the embodiment of this invention shown in FIG. 5 in use as an added thermal barrier, and FIG. 7 is a cross-sectional view of the embodiment of this invention shown in FIG. 6.

DESCRIPTION OF PREFERRED EMBODIMENTS

Referring first to FIG. 1, there is illustrated a prior art, pre-fabricated folding attic stair unit 10; such a unit being illustrative of one type of building unit with which embodiments of this invention may be utilized. As such, it includes a peripheral stairwell frame 12 which is designed to be secured to the floor joist in an attic, to which is affixed a closure panel 14 by means of hinges 16 about which the panel 14 may be swung with respect to the frame 12. The panel 14 may be normally biased toward the closed position by means of spring loaded support arms 18, 19. Affixed to the upper sides of the closure panel 14 is a ladder 20, made in three sections 20A, 20B, and 20C, which are pivotally affixed to each other, end to end, by means of hinges 21A and 21B respectively. The hinges 21A and 21B are oriented so as to reverse in bending direction with respect to each other, so that when the ladder is folded up, the tops of ladder sections 20A and 20B will be abutting, and bottoms of ladder sections 20B and 20C will be abutting.

FIG. 2 illustrates the unit shown in FIG. 1, folded up and positioned within a shipping carton 22 of the type which has heretofor been used. Such a carton typically has been a corrugated paper box, of appropriate design and weight to contain the unit 10 and protect it during shipment.

FIG. 3 illustrates an embodiment of the present invention in the form of a structural member 24, in use as an aid to shipping a unit of the type illustrated in FIG. 1. This embodiment, in the form generally of a shallow, hollow rectangle, has sides of substantially the same configuration and dimensions as the peripheral frame 12 of the unit 10. It may be made by known per se processes, such as "blow-molding", construction from slabstock, etc., using materials which are somewhat rigid structurally and preferably have good thermal insulating properties. Examples of materials which may be used advantageously in this connection include "Styrofoam" as produced by the Dow Chemical Company and "Chempol" as produced by the Freeman Chemical Corp. In selecting such materials, in addition to having adequate structural and thermal insulating characteristics for the desired uses, other criteria, such as fire, health, toxicity and other relevant factors may also be taken into consideration, commensurate with the paramount considerations of structural integrity sufficient to cause the member 24 to endure the stresses of normal use during shipment and in use as a thermal barrier as hereunafter described, and desired thermal barrier characteristics.

It should be noted that by virtue of the outer surfaces of the sides of the member 24 being substantially flush with the peripheral edge of the closure panel 14, the member 24 provides an effective support member against movement of the unit 10 within the outer carton 22; the latter, in this illustration, being otherwise of the corrugated paper box type heretofor used. This dimensional relationship is also significant when the member 24 is used for thermal insluation purposes as illustrated in FIG. 4.

Upon installation of the stairway unit as shown in FIG. 4, the peripheral frame 12 is secured to floor joist 26 so as to anchor the stairway unit into normal operating position; all in the normal known per se manner in which such units have heretofor been installed. Thereafter, however, the member 24 may be positioned atop the opening, with the edges of its sides juxtaposed to the top edges of the peripheral frame 12. This relationship is shown in the detail cross-section which is included as part of FIG. 7. By this means, after the stairs have been used to gain access to the attic, and before the stairs are returned to their normal storage position with the closure panel 14 positioned next to the peripheral frame 12, the member 24 may be positioned so as to rest with its edges on the top of the frame and positionally retained thereby the floor joist 26 projecting above the top edge of the frame 12. In this posture, the member 24 will be undisturbed when the stairs are in the storage position, and will provide an easily removeable, but effective, thermal barrier while the stairs are so stored.

In the embodiment of this invention illustrated in FIG. 5, a second element 28, made preferably from material having properties of the type described hereinbefore with respect to the member 24, and advantageously from the same material, is made to form, together with the first element 24, an enclosure which totally envelopes the unit 10 and the peripheral portions of which overlap those of the member 24 as illustrated. In this manner, the two members 24, 28 may themselves effectively form a shipping carton for the unit 10, or alternatively may be positioned within a corrugated paper or other outer container 30.

When installed comparably in manner to the installation shown in FIG. 4, the embodiment of FIG. 5 may, as shown in FIGS. 6 & 7, utilize the second member 28 as a supplementary thermal barrier to the first member 24, by positioning the member 28 about the member 24 and, preferably, attaching the inside of the side walls of the former to the outside of the side walls of the latter, as by nails, glue, or other known per se methods. The relative depth of the side walls of the members 24, 28 may be regulated with respect to each other so that appropriate clearances are effected with respect to the adjacent floor joists and, advantageously, so that a dead-air space 40 is created as an additional insulation barrier between bottoms of the members 24, 28, as shown particularly in the detail portion of FIG. 7.

It will be clear therefore that in use for energy conservation, embodiments of this invention, including the single member form as illustrated in FIGS. 3 and 4 as well as the double member form illustrated in FIGS. 5, 6 and 7, will readily accommodate the associated folding stair unit when it is in the stored position, but may easily be removed for access through the stairwell when the stairs are in the unfolded position. Such removal will, or course, be facilitated by making the members 24, 28 from relatively lightweight materials, such as the plastics previously identified.

From the foregoing, it will be apparent that through practice of the present invention, there is provided means to effect improved packaging as well as a desirable and effective energy saving device. Accordingly, it is to be understood that the embodiments of this invention herein shown and described are by way of illlustration and not of limitation, and that a wide variety of embodiments may be made without departing from the spirit or scope of this invention.

I claim:

1. For use in connection with a unitized building component having a peripheral support frame, a structural member made from material which is structurally rigid and of low thermal transmissivity, said structural member being bottomless, having a top, and having side walls, the outside surfaces in the region of the exposed bottom edges of which are configured substantially as are the outside surfaces of the peripheral support frame of the component with which said member is to be associated, in the region of the top surfaces of said support frame, whereby said structural member may be positioned with the exposed bottom edges of its side walls juxtaposed to the top surfaces of said peripheral support frame, for use as a packaging device for said component and for use as a removable insulation device for use with said component after installation.

2. The structural member described in claim 1 and a second member made from material which is strucurally rigid and of low thermal transmissivity, which is topless, has a floor, and has side walls, the inner surfaces of which conform substantially with the outer surfaces of the side walls of said structural member is positioned within said second member with the floor of said second member substantially parallel to the top of said structural member, whereby said second member may be positioned about the outer edges of the sides of said structural member and of said component for use as a packaging device, and may be inverted for use as a removeable insulation device with said component after installation.

3. The device described in claim 1 wherein the outer surfaces of all of the side walls of said structural member are substantially co-planar with the outer surfaces of the peripheral support frame of said component when the exposed edges of each are juxtaposed to the exposed edges of the other with the outer surfaces of two adjacent of the sidewalls one co-planar with two adjacent of the sidewalls of the other.

4. The device described in claim 2 wherein the outer surfaces of all of the side walls of said structural member are substantially co-planar with the outer surfaces of the peripheral support frame of said component when the exposed edges of each are juxtaposed to the exposed edges of the other with the outer surfaces of two adjacent of the sidewalls one co-planar with two adjacent of the sidewalls of the other.

5. The device described in claims 1, 2, 3, or 4 adapted for use with a pre-fabricated lowerable attic stair unit.

6. A method of insulating a pre-fabricated building component having a peripheral support frame comprising the steps of positioning atop said component a structural member made from material which is structurally rigid and of low thermal transmissivity and has a top and an open bottom, and side walls, the outside surfaces in the region of the exposed bottom edges of which are configured substantially as are the outside surfaces of said peripheral support frame in the region of the top surfaces thereof, and positioning inverted atop said structural member a second member made from material which is structurally rigid and of low thermal transmissivity, and has an open top and a bottom, and side walls, the inner surfaces of which conform substantially with the outer surfaces of the side walls of said structural member when said structural member is positioned within said second member with the floor of said second member substantially parallel to the top of said structural member.

7. The method described in claim 6, including the added step of making a structural member from material which is structurally rigid and has low thermal transmissivity, and has a top and an open bottom, and side walls, the outside surfaces in the region of the exposed bottom edges of which are configured substantially as are the outside surfaces of said peripheral support frame in the region of the top surfaces thereof.

8. The method described in claim 6 including the added step of making said second member from material which is structurally rigid and of low thermal transmissivity, and has an open top and a bottom, and side walls, the interior surfaces of which are dimensioned and configured so as to conform substantially with the corresponding outer surfaces of the side walls of said structural member when said structural member is positioned within said second member with the floors of the two substantially parallel.

9. A method of packaging a pre-fabricated building component having a peripheral support frame comprising the steps of positioning atop said support frame a structural member made from material which is structurally rigid and of low thermal transmissivity, is bottomless, has a top and has side walls, the outer surfaces in the region of the bottom edges of which are so configured and dimensioned that they will conform substantially to the outer surfaces of said peripheral support frame, in the region of the top surfaces thereof, and positioning said component, with said structural member positioned atop said component with the exposed edges of the sides of said component juxtaposed to the top surfaces of said peripheral frame, within a second member made from material which is structurally rigid and of low thermal transmissivity, and has an open top, and side walls the inner surfaces of which conform substantially with the outer surfaces of the side walls of said structural member.

10. The method described in claim 9 including the added step of making a structural member from material which is structurally rigid and of low thermal transmissivity, bottomless, with a top, and with side walls, the outersurfaces of which in the region of the bottom edges of which are so configured as to conform substantially to the outer surfaces of said peripheral support frame in the region of the top surfaces thereof.

11. The method described in either claim 10 or claim 9 including the added step of making said second member from material which is structurally rigid and of low transmissivity, topless, with a bottom, and with side walls, the inner surfaces of which conform substantially dimensionally and in configuration with the outer surfaces of the side walls of said structural member.

* * * * *